US007176836B2

(12) United States Patent
Chen

(10) Patent No.: US 7,176,836 B2
(45) Date of Patent: Feb. 13, 2007

(54) ANTENNA SYSTEM DESIGNED TO ENHANCE POWER EFFICIENCY

(75) Inventor: Ching-Feng Chen, Hsinchu (TW)

(73) Assignee: Z-Com, Inc., Hsinchu (TW)

( * ) Notice: Subject to any disclaimer, the term of this patent is extended or adjusted under 35 U.S.C. 154(b) by 0 days.

(21) Appl. No.: 11/094,219

(22) Filed: Mar. 31, 2005

(65) Prior Publication Data

US 2006/0220960 A1 Oct. 5, 2006

(51) Int. Cl.
*H01Q 1/38* (2006.01)

(52) U.S. Cl. ..... 343/700 MS; 343/872

(58) Field of Classification Search ..... 343/700 MS, 343/795, 872, 702, 834
See application file for complete search history.

(56) References Cited

U.S. PATENT DOCUMENTS 6,492,950 B2 * 12/2002 Nakano et al. ..... 343/700 MS
6,816,120 B2 * 11/2004 Kuramoto ..... 343/702
6,914,581 B1 * 7/2005 Popek ..... 343/909

FOREIGN PATENT DOCUMENTS

JP 2002-141742 * 5/2002
TW 558080 10/2003

* cited by examiner

*Primary Examiner*—Hoang V. Nguyen
*Assistant Examiner*—Ephrem Alemu
(74) *Attorney, Agent, or Firm*—Rabin & Berdo, P.C.

(57) ABSTRACT

An antenna system designed to enhance power efficiency of a patch antenna for wireless transmission is provided. The system includes a patch antenna, a reflective plate, a transmission line, and a printed circuit board assembly. The reflective plate is arranged at the position of ¼λ away from the patch antenna, to reflect the electro-magnetic waves, radiated behind the patch antenna. Because the antenna and the reflective plate are away from ¼λ, the reflective signals returned to the patch antenna constructively interfere with the signal radiated from the antenna. Therefore, the provided system may strengthen the gain of the antenna. Further, the electromagnetic interference is decreased at the position close to the printed circuit board assembly behind the reflective plate.

9 Claims, 2 Drawing Sheets

ANTENNA SYSTEM DESIGNED TO ENHANCE POWER EFFICIENCY

FIELD OF THE INVENTION

The present invention relates to a patch antenna for use on electronic devices in wireless transmission and particularly to an antenna system that is coupled with a reflective plate to increase the gain of an antenna in a selected direction.

BACKGROUND OF THE INVENTION

With the wireless communication industry thriving tremendously in recent years, handset systems or wireless network systems all adopt wireless transmission systems to transmit information. Transmissions among base stations, or between the base stations and handsets, wireless network cards or the like, have to rely on antennas. A wireless transmitter outputs radio frequency power, which is sent to an antenna through a transmission line, and radiated by the antenna in the form of electro-magnetic waves. At a receiving location, another antenna receives the electro-magnetic waves, which are sent to a wireless receiver through another transmission line. Hence the antenna is an important device in the transmission and reception of electro-magnetic waves. Without the antenna, wireless communication cannot function at all.

Although wireless communication does not have spatial restriction, the electro-magnetic wave tends to attenuate when encounters obstructions (such as walls, metal barriers or the like) in the transmission direction. As a result, receiving quality at the receiving end could be undesirable. In general, if an antenna is designed with a selected transmission direction characteristics, it is called a directional antenna. It aims to enhance the power of the antenna in the selected direction to increase the transmission distance. Such type of antenna usually has a reflective plate on one side, to increase the directionality of the antenna and boost the gain of the antenna, thereby an improved transmission quality may be achieved.

For instance, R.O.C. patent publication No. 558080 discloses a dipole antenna equipped with a reflective plate. It includes a dipole antenna and a reflective plate. Its main feature is that the reflective plate has an opening. The reflective plate is located on one side of the dipole antenna at a selected distance. The shortest distance between the dipole antenna and the reflective plate is ¼λ. The reflective plate can reflect radiated signals for transmission and receiving, to increase the directional radiation gain of the dipole antenna.

Although the reflective signal of the dipole antenna can increase the directional gain, the reflective plate is designed with a bending angle. Moreover, the directionality is omni-directional. For antennas that require a higher directionality, the directional gain is not satisfactory. Moreover, the design of the reflective plate is too complicated and difficult to assemble and install. Hence to enhance the antenna directionality, and simplify the design of the reflective plate to facilitate installation of the antenna system, issues still remain to be resolved.

SUMMARY OF THE INVENTION

In view of the aforesaid problems, the primary object of the present invention is to provide a patch antenna system capable of enhancing output power. The invention couples the patch antenna and a reflective plate. The reflective plate can reflect electro-magnetic waves behind the patch antenna to generate a constructive interference with the electromagnetic waves at the front side of the patch antenna, to increase the amplitude of the electromagnetic waves at the front side of the patch antenna, thereby to enhance the directionality of the antenna. Moreover, as the reflective plate reflects the electromagnetic waves behind the patch antenna, the electromagnetic interference is reduced for the printed circuit board assembly (PCBA) behind the reflective plate.

To achieve the aforesaid object, the patch antenna system according to the invention includes a PCBA to generate or receive data signals, a transmission line to transmit the signals generated by the PCBA to an antenna, a connector to connect the PCBA to the transmission line, and a reflective plate located between the PCBA and the antenna. The antenna is a directional patch antenna connecting to the transmission line to radiate the signals transmitted from the PCBA. The reflective plate is spaced from the patch antenna at a distance of ¼λ.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
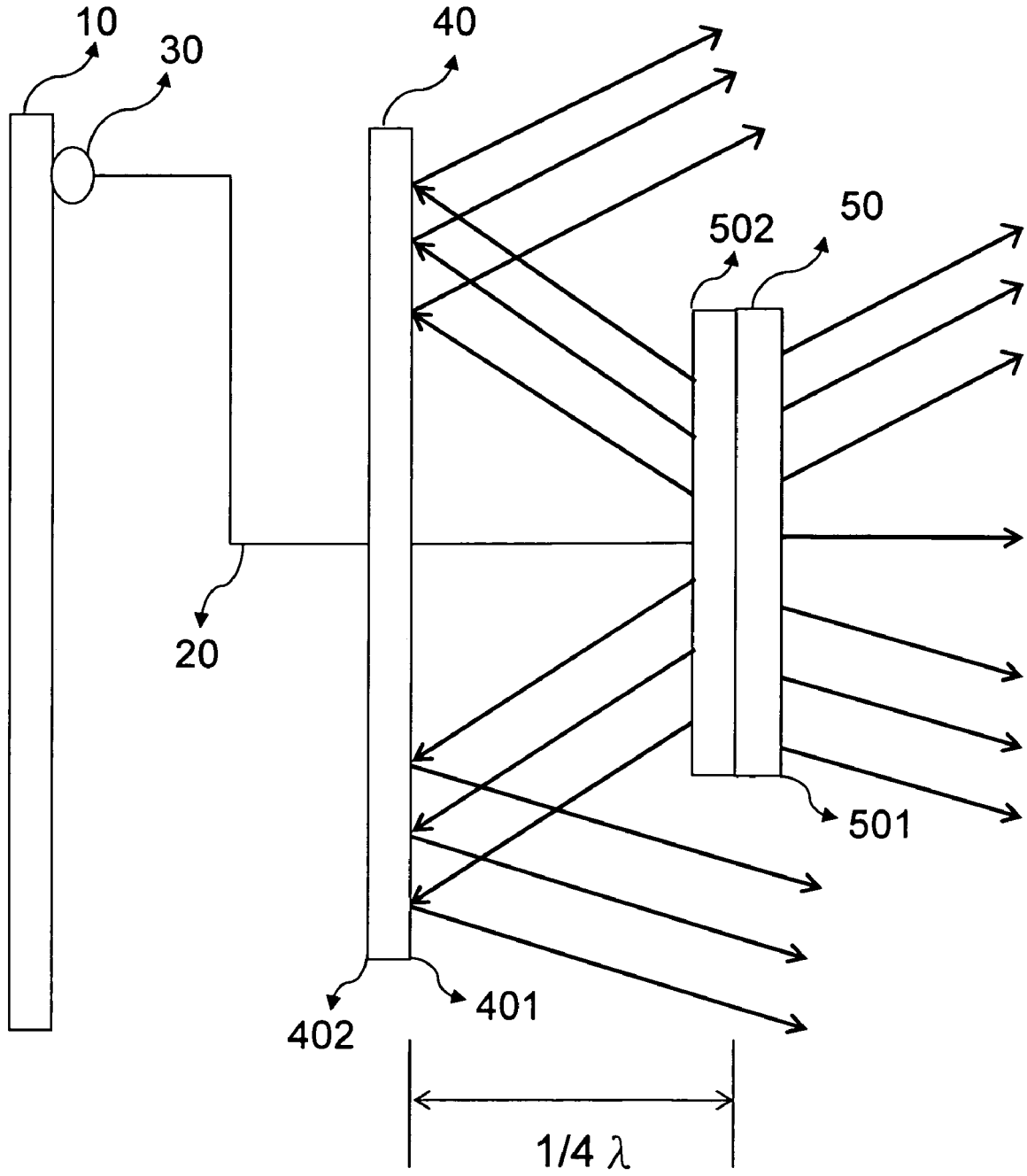
FIG. 1 is a schematic view of an antenna system.

Referring to FIG. 1, the invention is adopted for use on a 2.4 GHz access point (AP). It includes a printed circuit board assembly (PCBA) 10, a transmission line 20, a connector 30, a reflective plate 40 and an antenna 50.

The PCBA 10 includes a printed circuit board power supply, a ground bus wiring structure and an internal system which has an analog circuit or a digital circuit. The size of the PCB matches the dimension of the outer cover. In the invention, the PCBA 10 is positioned in the direction of a second plane 402 of the reflective plate and close to the second plane 402 to facilitate the external wiring layout, and also make the size of elements smaller.

The PCB is connected to external elements through a plastic transmission line or metal shielded line. It may also be designed in a socket fashion. The invention connects the PCBA 10 with the transmission line 20 through the connector 30, which is capable of transmitting microwave signals. To transmit the microwave signals, the connector 30 is a SMA connector. After it has been coupled with the transmission line 20, the transmission line 20 passes through an aperture in the center of the reflective plate 40 to be connected to the antenna 50. The transmission line 20 can transmit microwaves of a high frequency. It is not being wound from outside, but directly passes through the aperture in the center of the reflective plate 40 to be connected to the antenna 50 at a shorter path and a lower cost. Such an approach also reduces the loss of the microwave traveling on the transmission line 20. The size of the aperture affects the reflective wave, and also affects the distance of ¼λ between the reflective plate 40 and the antenna 50 for generating the optimum gain. The actual size of the aperture and the measured gain of the antenna have to be tested to obtain the optimal position and the size of the aperture.

The reflective plate has a first plane 401 which is spaced from a second planar surface 502 of the antenna at a distance of ¼λ. At such a distance, the reflective wave from the second plane 402 of the reflective plate and the transmitting signals of the antenna 50 will generate a constructive interference. Compared with the general antenna that does not have a reflective plate, the construction interference of the invention can increase the signal amplitude and boost the gain of the antenna, and enhance the directionality of the antenna. The reflective plate 40 may be made of metal or an insulation member, plated with metal. It forms a shielding effect to the electromagnetic wave generated by the antenna in the direction of the second planar surface 502, so that the electromagnetic wave may be reflected in the direction of a first planar surface 501 of the antenna.

The antenna 50 is a directional antenna to radiate radio signals by coupling a magnetic field and an electric field, or transform received electromagnetic waves into electric signals. The direction of the antenna is the direction of the first planar surface 501. However, there is still a small amount of electromagnetic waves in the direction of the second planar surface 502. These electromagnetic waves travel a distance of ¼λ and reach the reflective plate 40, and are reflected to the antenna 50 for a distance of another ¼λ, to generate a constructive interference with the electromagnetic wave radiated by the antenna 50. As shown in FIG. 1, the antenna 50 has a size smaller than the reflective plate 40. Hence besides having increased gain in the direction of the first planar surface 501 of the antenna, the electromagnetic wave also radiates in the upper and lower directions of the antenna 50, thus the transmission dead ends of the antenna 50 are improved.

Moreover, the reflective plate 40 provides a shielding effect to prevent the electro-magnetic waves from interfering with the PCBA 10 behind the reflective plate 40. Hence it enables the circuit to function to be more stable in high frequencies.

Figure 2:
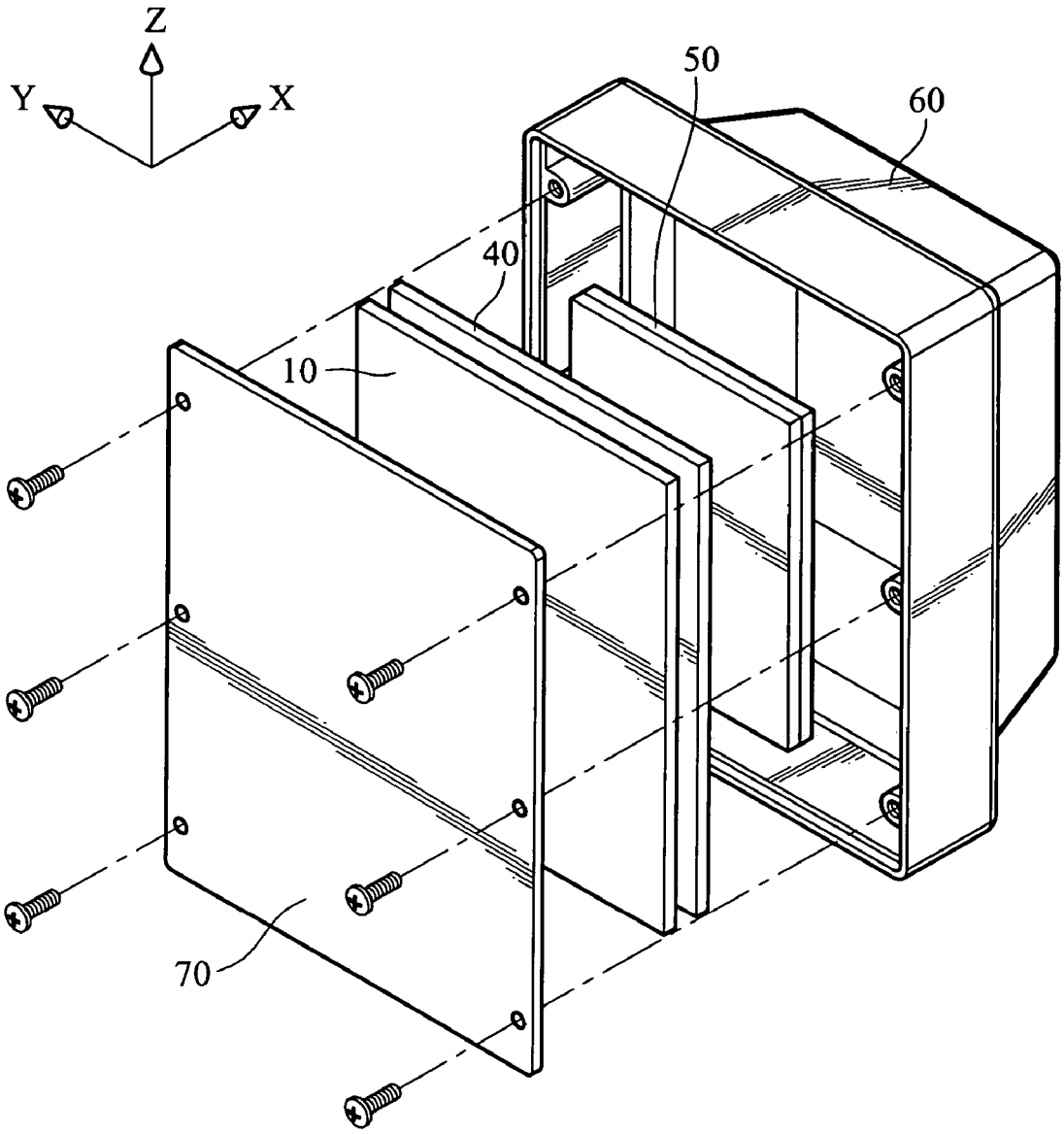
FIG. 2 is an exploded view of an antenna.

Refer to FIG. 2 for an exploded view of the invention. There is a case 60 coupled with a base 70 to encase the antenna 50, reflective plate 40 and PCBA 10. The base 70 has a plurality of apertures to receive fastening elements (such as plastic rivets, drawing nails, screws or the like), to fasten to the case 60 to become a tightly coupled body to protect the antenna 50, reflective plate 40 and PCBA 10. The case 60 has a recess to hold the reflective plate 40, which has a plurality of apertures to receive fastening elements to fasten to the case. The antenna 50 has a smaller size and is located in a hollow chamber, formed between the case 60 and the reflective plate 40.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments, which do not depart from the spirit and scope of the invention.

What is claimed is:

1. An antenna system to enhance power efficiency, comprising:

a patch antenna to radiate signals or receive radiation signals;

a reflective plate having a first plane and a second plane, wherein the first plane of the reflective plate is located on one side of the patch antenna at a distance of ¼ of the antenna wavelength, and the reflective plate is of planar plate shape; and a printed circuit board assembly located on one side facing the second plane of the reflective plate to transmit or receive the radiation signals to the patch antenna.

2. The antenna system of claim 1, wherein the patch antenna and the reflective plate are further located in a case.

3. The antenna system of claim 1, wherein the patch antenna is a directional antenna.

4. The antenna system of claim 1, wherein the reflective plate is a metal plate or a substrate plated with metal on outer layer of the substrate.

5. The antenna system of claim 1, wherein the area of the reflective plate is larger than that of the patch antenna.

6. The antenna system of claim 1, wherein a transmission line is used to connect the patch antenna with the printer circuit board assembly.

7. The antenna system of claim 6, wherein the transmission line is connected to the printed circuit board assembly through a connector.

8. The antenna system of claim 1, wherein the reflective plate has an aperture to allow the transmission line to pass through to be connected to the patch antenna.

9. The antenna system of claim 1, wherein the reflective plate has a plurality of apertures to receive fastening elements to fasten the reflective plate to a case.

* * * * *